US010458430B2

(12) United States Patent
Nakaniwa et al.

(10) Patent No.: US 10,458,430 B2
(45) Date of Patent: Oct. 29, 2019

(54) CENTRIFUGAL-COMPRESSOR CASING AND CENTRIFUGAL COMPRESSOR

(71) Applicant: MITSUBISHI HEAVY INDUSTRIES COMPRESSOR CORPORATION, Tokyo (JP)

(72) Inventors: Akihiro Nakaniwa, Tokyo (JP); Satoru Yoshida, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 234 days.

(21) Appl. No.: 15/539,808

(22) PCT Filed: Jan. 29, 2015

(86) PCT No.: PCT/JP2015/052449
§ 371 (c)(1),
(2) Date: Jun. 26, 2017

(87) PCT Pub. No.: WO2016/121046
PCT Pub. Date: Aug. 4, 2016

(65) Prior Publication Data
US 2017/0370377 A1 Dec. 28, 2017

(51) Int. Cl.
*F04D 29/44* (2006.01)
*F04D 29/42* (2006.01)
(Continued)

(52) U.S. Cl.
CPC ..... *F04D 29/4226* (2013.01); *F04D 17/10* (2013.01); *F04D 17/122* (2013.01);
(Continued)

(58) Field of Classification Search
CPC .. F04D 17/105; F04D 29/4213; F04D 29/242; F04D 29/444; F05D 2250/51; F05D 2260/606
See application file for complete search history.

(56) References Cited

U.S. PATENT DOCUMENTS 2,405,048 A * 7/1946 Nickerson ..... F04D 29/441 415/142
4,428,714 A * 1/1984 Mowill ..... F04D 27/0253 415/161
(Continued)

FOREIGN PATENT DOCUMENTS

JP 8-232893 A 9/1996
JP 2013-113098 A 6/2013
JP 5649758 B2 1/2015

OTHER PUBLICATIONS

International Search Report and Written Opinion of the International Searching Authority (Forms PCT/ISA/237 and PCT/ISA/210), dated Apr. 28, 2015, for International Application No. PCT/JP2015/052449, with an English translation.

*Primary Examiner* — Ninh H. Nguyen
(74) *Attorney, Agent, or Firm* — Birch, Stewart, Kolasch & Birch, LLP

(57) ABSTRACT

A centrifugal compressor includes a casing body (11) configured to rotatably support a rotation shaft (2) and an impeller (3) fixed to the rotation shaft around an axis (O), the casing body in which an intake volute (B1) which has a ring shape centered on the axis and through which a processing gas (G) is caused to flow in a direction of the axis and is introduced into a flow channel of the impeller, and a discharge volute which has a ring shape centered on the axis and through which the processing gas is discharged from the flow channel are formed; and a plurality of intake nozzles (16) which communicate with the intake volute and are able
(Continued)

to cause the processing gas to flow into the intake volute from the outside and are provided at intervals in a circumferential direction around the rotation shaft.

6 Claims, 5 Drawing Sheets

(51) Int. Cl.
*F04D 17/10* (2006.01)
*F04D 17/12* (2006.01)
*F04D 29/70* (2006.01)

(52) U.S. Cl.
CPC ..... *F04D 29/4213* (2013.01); *F04D 29/441* (2013.01); *F04D 29/444* (2013.01); *F04D 29/701* (2013.01)

(56) References Cited

U.S. PATENT DOCUMENTS

| | | | | |
|---|---|---|---|---|
| 9,347,450 | B2 * | 5/2016 | Wang | F04D 25/0606 |
| 2009/0301085 | A1 * | 12/2009 | Heyes | F01D 17/14 60/611 |
| 2015/0192147 | A1 | 7/2015 | An et al. | |

* cited by examiner

CENTRIFUGAL-COMPRESSOR CASING AND CENTRIFUGAL COMPRESSOR

TECHNICAL FIELD

The present invention relates to a casing in a centrifugal compressor and a centrifugal compressor including the casing.

BACKGROUND ART

For example, a centrifugal compressor is used to compress a processing gas in various plants. In the centrifugal compressor, a processing gas taken into an intake volute from an intake nozzle is compressed in a flow channel of an impeller that rotates together with a rotation shaft, and is then discharged from a discharge nozzle.

Here, as a structure of the intake volute of the centrifugal compressor, for example, as shown in FIG. 5 in Patent Literature 1, a flow split type structure in which a processing gas taken from an intake nozzle flows through two divided paths, the left and right paths, along a casing is known in the related art.

CITATION LIST

Patent Literature

[Patent Literature 1]

Japanese Unexamined Patent Application First Publication No. H 8-232893

SUMMARY OF INVENTION

Technical Problem

Incidentally, the demand for reducing the size of a centrifugal compressor is increasing now. However, in the flow split type structure of the related art as described in Patent Literature 1, when simply the size is reduced, a flow velocity of a processing gas in the intake volute increases and it is necessary to quickly change a flow of a processing gas in the narrow intake volute along an axis of a rotation shaft. Therefore, a processing gas is likely to be released in the intake volute, a pressure loss occurs, and performance is likely to be degraded.

The present invention provides a centrifugal-compressor casing and a centrifugal compressor which can be reduced in size while maintaining performance.

Solution to Problem

A centrifugal-compressor casing according to a first aspect of the present invention includes a casing body configured to rotatably support a rotation shaft and an impeller fixed to the rotation shaft around an axis of the rotation shaft, the casing body in which an intake volute which has a ring shape centered on the axis and through which a fluid is caused to flow in a direction of the axis and is introduced into a flow channel of the impeller, and a discharge volute which has a ring shape centered on the axis and through which the fluid is discharged from the flow channel of the impeller are formed; and a plurality of intake nozzles which communicate with the intake volute and are able to cause the fluid to flow into the intake volute from the outside and are provided at intervals in a circumferential direction around the rotation shaft.

In this manner, since the plurality of intake nozzles that communicate with the intake volute are provided with intervals in the circumferential direction, fluid portions flowing into the intake volute from the intake nozzles collide with each other in the intake volute so that it is possible to quickly change a direction in which the fluid flows to the direction of the axis. Therefore, there is no need to separately provide a member (such as a wing member) for quickly changing a direction in which the fluid flows to the direction of the axis in the intake volute. Therefore, it is possible to prevent the occurrence of release of the fluid in the intake volute or the like due to the provision of such a member. In addition, when the plurality of intake nozzles are provided, it is possible to cause the fluid to uniformly flow into the intake volute from the intake nozzles in the circumferential direction. Accordingly, it is possible to uniformly introduce the fluid into the flow channel of the impeller in the circumferential direction.

In a centrifugal-compressor casing according to a second aspect of the present invention, the plurality of intake nozzles according to the first aspect include a main intake nozzle that is provided in the outer casing at one part in the circumferential direction around the rotation shaft and an auxiliary intake nozzle that is provided in the outer casing apart from the main intake nozzle in the circumferential direction around the rotation shaft, and the centrifugal-compressor casing may further include a bypass line which connects the main intake nozzle and the auxiliary intake nozzle and through which the fluid is able to flow.

Some of the fluid that passes through the bypass line from the main intake nozzle and flows into the intake volute from the main intake nozzle can be caused to flow into the intake volute through the auxiliary intake nozzle. That is, when the plurality of intake nozzles are provided at intervals in the circumferential direction, it is possible to cause the fluid to flow into the intake volute from the intake nozzles. As a result, fluid portions flowing into the intake volute from the main intake nozzle and the auxiliary intake nozzle collide with each other while the occurrence of release of the fluid in the intake volute or the like is prevented so that it is possible to quickly change a direction in which the fluid flows to the direction of the axis. In addition, it is possible to cause the fluid to uniformly flow into the intake volute in the circumferential direction and it is possible to uniformly introduce the fluid into the flow channel of the impeller in the circumferential direction.

In a centrifugal-compressor casing according to a third aspect of the present invention, the plurality of intake nozzles according to the first aspect may be a plurality of main intake nozzles which are provided in the casing body apart from each other in the circumferential direction around the rotation shaft.

In this manner, when the plurality of main intake nozzles are provided at intervals in the circumferential direction as intake nozzles, fluid portions flowing into the intake volute from the main intake nozzles collide with each other while the occurrence of release of the fluid in the intake volute or the like is prevented so that it is possible to quickly change a direction in which the fluid flows to the direction of the axis. In addition, it is possible to cause the fluid to uniformly flow into the intake volute in the circumferential direction and it is possible to uniformly introduce the fluid into the flow channel of the impeller in the circumferential direction.

In a centrifugal-compressor casing according to a fourth aspect of the present invention, the plurality of intake nozzles in the second or third aspect may be arranged at equal intervals in the circumferential direction around the rotation shaft.

When the intake nozzles are arranged with equal intervals in this manner, it is possible for fluid portions from the intake nozzles to effectively collide with each other and it is possible to introduce the fluid into the flow channel of the impeller in the circumferential direction more uniformly.

In a centrifugal-compressor casing according to a fifth aspect of the present invention, in the casing body according to any of the first to fourth aspects, the intake volute may be formed such that a radial distance between the rotation shaft and an inner surface of the intake volute decreases away from positions at which the intake nozzles are provided in the circumferential direction around the rotation shaft.

A radial distance between the rotation shaft and the inner surface of the intake volute, that is, a flow channel area in the intake volute, decreases away from the intake nozzles in the circumferential direction. Therefore, it is possible to increase a flow velocity of the fluid at a position away from the intake nozzles and it is possible to uniformize a flow rate of the fluid introduced into the flow channel of the impeller in the circumferential direction.

A centrifugal compressor according to a sixth aspect of the present invention includes the casing according to any one of the first to fifth aspects, a rotation shaft that is supported by the casing to be rotatable with respect to the casing; and an impeller that is fixed to the rotation shaft and rotates in the casing body together with the rotation shaft.

Fluid portions flowing into the intake volute from the intake nozzles provided in the casing collide with each other in the intake volute so that it is possible to quickly change a direction in which the fluid flows to the direction of the axis. In this case, it is possible to prevent the occurrence of release of the fluid in the intake volute or the like. In addition, since it is possible to cause the fluid to uniformly flow into the intake volute from the intake nozzle in the circumferential direction, it is possible to uniformly introduce the fluid into the flow channel of the impeller in the circumferential direction.

Advantageous Effects of Invention

According to the above centrifugal-compressor casing and centrifugal compressor, when a plurality of intake nozzles are provided, it is possible to reduce the size while maintaining performance.

DESCRIPTION OF EMBODIMENTS

First Embodiment

A centrifugal compressor 1 according to an embodiment of the present invention will be described below.

Figure 1:
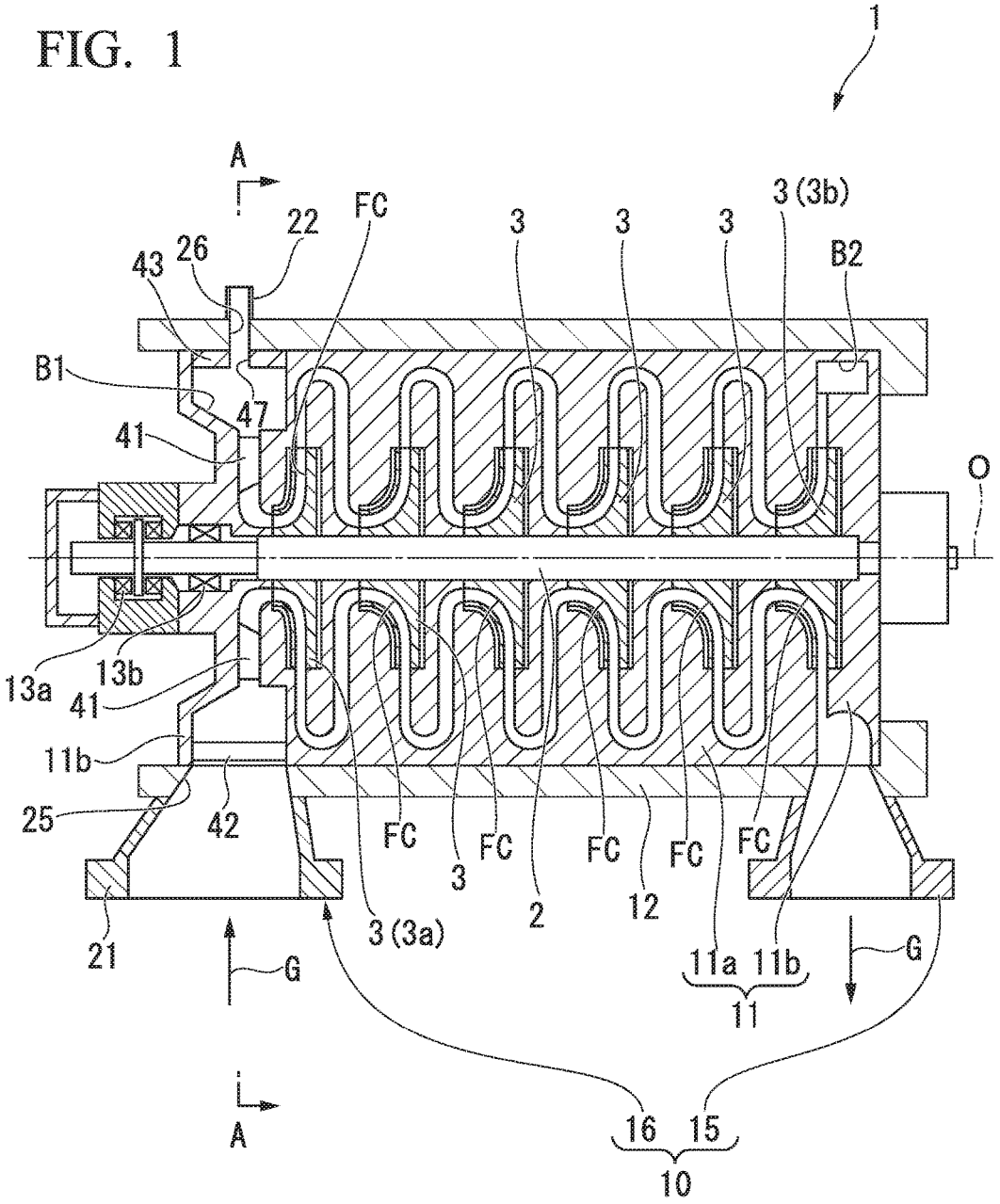
FIG. 1 is a vertical cross-sectional view showing a schematic configuration of a centrifugal compressor according to a first embodiment of the present invention.

As shown in FIG. 1, the centrifugal compressor 1 mainly includes a rotation shaft 2 that rotates about an axis O, impellers 3 that are fixed to the rotation shaft 2 and configured to compress a processing gas G, which is a fluid, using a centrifugal force, and a casing 10 rotatably supporting the rotation shaft 2.

The rotation shaft 2 has a cylindrical shape centered on the axis O.

The plurality of impellers 3 are arranged apart from each other in a direction of the axis O.

Each of the impellers 3 has substantially a disk shape and is rotatable about the axis O together with the rotation shaft 2 when engaged with the rotation shaft 2. In addition, a flow channel FC through which the processing gas G can flow is formed in each of the impellers 3.

The casing 10 covers each of the impellers 3 from the outer peripheral side and includes a casing body 11 in which a thrust bearing 13*a* and a radial bearing 13*b* rotatably supporting the rotation shaft 2 and the impellers 3 are provided, an outer casing body 12 that covers the casing body 11 from the outer peripheral side, and an intake nozzle 16 and a discharge nozzle 15 provided in the outer casing body 12.

In the present embodiment, the casing body 11 is a bundle that includes a plurality of disk-shaped diaphragms 11*a* around the axis O and a head 11*b* disposed at both ends of these diaphragms in the direction of the axis O. Here, the casing body 11 is formed when the diaphragms 11*a* and the heads 11*b* are fixed by a bolt 20 (refer to FIG. 2) inserted in the direction of the axis O and has a cylindrical shape as a whole.

In the casing body 11, an intake volute B1 is formed on one side in the direction of the axis O relative to an impeller 3*a* which is an inlet side of the first stage impeller 3*a* (an impeller 3 arranged at one end in the direction of the axis O).

In addition, in the casing body 11, a discharge volute 132 which is formed in a radially outward direction from the impeller 3*b* is an outlet side of a final stage impeller 3*b* (an impeller 3 on the other side in the direction of the axis O).

The intake volute B1 is formed in the casing body 11, and has a ring shape centered on the axis O, and through which the processing gas G that flows in from outside in a radial direction of the casing body 11 is caused to flow in the direction of the axis O and is introduced into the flow channel FC of the first stage impeller 3*a*.

The discharge volute B2 is formed in the casing body 11, and has a ring shape centered on the axis O, and through which the processing gas G flowing outward in a radial direction from the flow channel FC of the final stage impeller 3*b* is discharged to the outside from the casing body 11.

The outer casing body 12 has a cylindrical shape centered on the axis O, and covers the casing body 11 from the outer peripheral side, and fixes the casing body 11.

The discharge nozzle 15 is provided in the outer casing body 12, communicates with the discharge volute B2, and can discharge the processing gas G from the discharge volute B2. That is, the discharge nozzle 15 extends in a radially outward direction from the outer casing body 12 at a position in the direction of the axis O corresponding to a position at which the discharge volute B2 is formed. Only one discharge nozzle 15 may be provided in the circumferential direction in the outer casing body 12 or a plurality of discharge nozzles 15 may be provided apart from each other in the circumferential direction.

The intake nozzle 16 communicates with the intake volute B1 and can take the processing gas G into the intake volute B1 from the outside. That is, the intake nozzle 16 extends in a radially outward direction from the outer casing body 12 at a position in the direction of the axis O corresponding to a position at which the intake volute B1 is formed.

Figure 2:
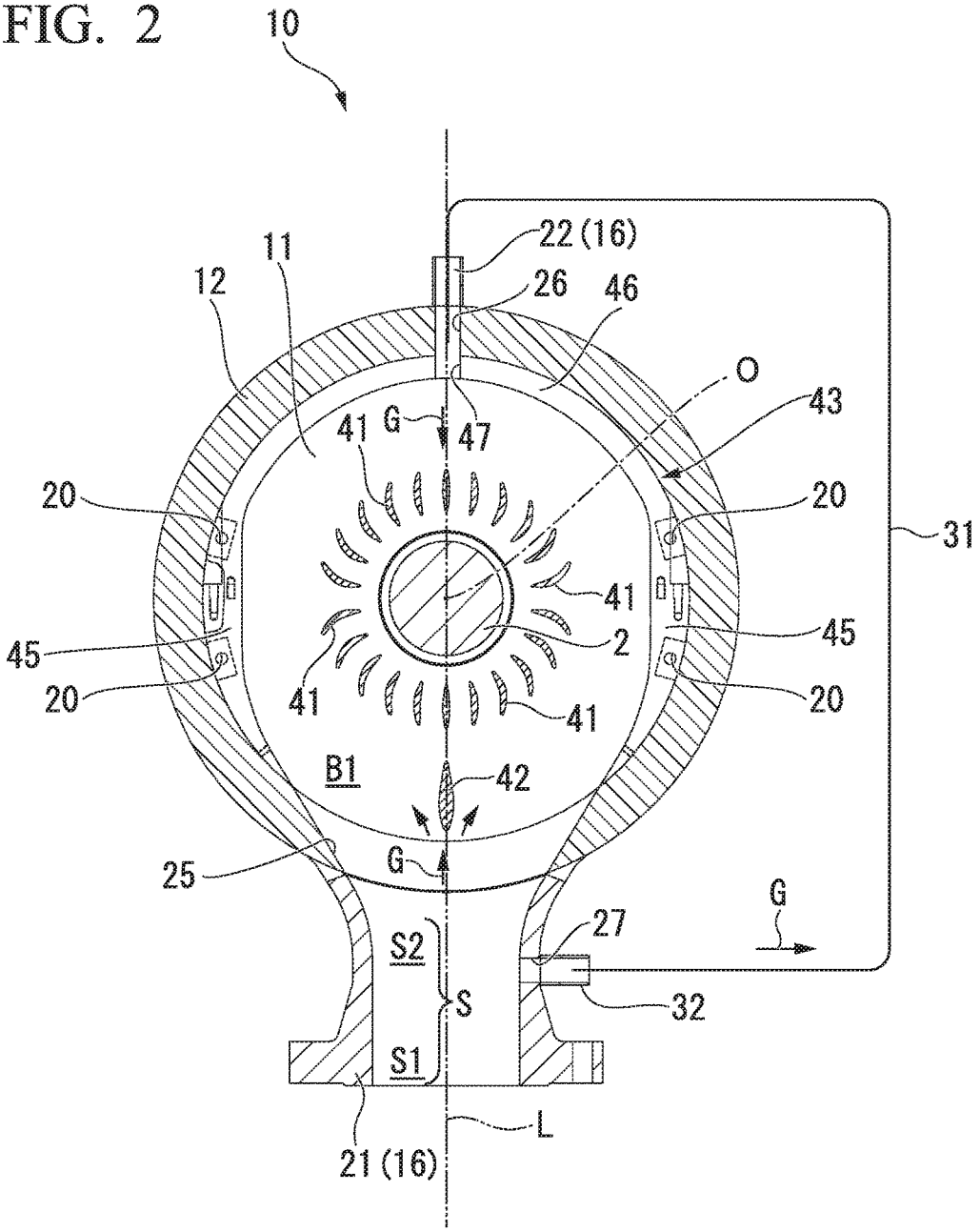
FIG. 2 is a cross-sectional view orthogonal to an axis of a rotation shaft of the centrifugal-compressor casing according to the first embodiment of the present invention and is a diagram showing the cross section A-A in FIG. 1.

As shown in FIG. 2, the intake nozzle 16 includes a main intake nozzle 21 that is provided at one part (the lower part) in the circumferential direction in the outer casing body 12 and an auxiliary intake nozzle 22 that is provided in the outer casing body 12 at a position 180 degrees apart from the main intake nozzle 21 in the circumferential direction.

In addition, the centrifugal compressor 1 of the present embodiment further includes a bypass line 23 that connects the main intake nozzle 21 and the auxiliary intake nozzle 22.

In the main intake nozzle 21, from the outside to the inside in a radial direction, a cross-sectional area of a cross section orthogonal to an internal space S in the radial direction in which the processing gas G flows gradually increases in diameter toward the outer casing body 12. More specifically, the space S includes a columnar first space S1 centered on an imaginary line L that extends in the radial direction and a columnar second space S2 that is continuous with the first space S1 and centered on the imaginary line L that is formed to smoothly extend from the first space S1 in the circumferential direction toward the outer casing body 12.

In addition, the second space S2 of the main intake nozzle 21 is formed on the outer peripheral surface of the outer casing body 12 and is smoothly continuous without a step with a main opening 25 which is a hole formed around the above imaginary line L.

The main opening 25 of the outer casing body 12 is a hole in which a cross-sectional area of a cross section orthogonal to the imaginary line L that extends in the radial direction gradually increases in diameter in a radially inward direction.

The auxiliary intake nozzle 22 is a cylindrical member, is attached to the outer casing body 12 at a position of an auxiliary opening 26 formed in the outer casing body 12, and is provided to protrude from the outer casing body 12 in a radially outward direction.

The auxiliary opening 26 of the outer casing body 12 is a hole centered with respect to the above imaginary line L that vertically extends in the radial direction.

As described above, in the present embodiment, a hole center of the main opening 25 and a hole center of the auxiliary opening 26 are arranged at positions 180 degrees apart from each other in the circumferential direction around the rotation shaft 2.

The bypass line 23 includes a pipe portion 31 that is connected to the auxiliary intake nozzle 22 and a connecting portion 32 that is connected to the pipe portion 31 and is attached to the main intake nozzle 21.

The pipe portion 31 is a pipe which is arranged outside the outer casing body 12 and in which the processing gas G can flow.

The connecting portion 32 is a cylindrical member attached to an opening for bypass 27 that is formed to penetrate the main intake nozzle 21 in the circumferential direction around the rotation shaft 2. In this manner, some of the processing gas G taken from the main intake nozzle 21 into the intake volute B1 is made to diverge through the bypass line 23 and is taken into the intake volute B1 from the auxiliary intake nozzle 22 due to a differential pressure.

The opening for bypass 27 is formed at a boundary position between the first space S1 and the second space S2 in the main intake nozzle 21. That is, the connecting portion 32 is provided at the boundary position.

Next, the intake volute B1 will be described in further detail with reference to FIG. 2.

The intake volute B1 is a gas flow channel of the processing gas G which is formed on the outer peripheral side of the rotation shaft 2 and has a ring shape centered on the axis O.

In the outer casing body 12 inside the intake volute B1, a plurality of guide wings 41 are arranged radially around the axis O to surround the rotation shaft 2.

The guide wings 41 are arranged in a bilaterally symmetrical form centered with respect to the above imaginary line L. In each of the guide wings 41, a cross-sectional shape orthogonal to the axis O curves toward the radial direction with respect to the rotation shaft 2 as it becomes closer to the rotation shaft 2. Therefore, the guide wings 41 can introduce the processing gas G from the main intake nozzle 21 toward the flow channel FC of the impeller 3 from the outside in the radial direction and from one side of the axis O.

In addition, inside the intake volute B1, in the vicinity of the main opening 25 formed in the outer casing body 12, one entrance rectification plate 42 arranged along the above imaginary line L is provided.

The entrance rectification plate 42 is arranged between the outer casing body 12 and the guide wings 41 and has a cross-sectional shape orthogonal to the axis O, that is, a wing shape which bulges at the middle portion in the radial direction. Due to the entrance rectification plate 42, the processing gas G taken from the main intake nozzle 21 is diverted to both sides in the circumferential direction.

In addition, a gas flow channel defining member 43 is fixed to an inner circumferential surface of the outer casing body 12.

The gas flow channel defining member 43 has a frame shape that is formed along the inner circumferential surface of the outer casing body 12 and an inner circumferential surface facing the inside of the gas flow channel defining member 43 in the radial direction forms the outer edge of the intake volute B1. The inner circumferential surface of the gas flow channel defining member 43 is smoothly continuous without a step from the main opening 25 of the outer casing body 12.

The gas flow channel defining member 43 includes a pair of thick portions 45 that protrude in a radially inward direction from the inner circumferential surface of the outer casing body 12 to the greatest extent at positions on both sides in the circumferential direction 90 degrees away from the imaginary line L, that is, away from a position at which the main opening 25 is formed. The thick portions 45 are portions into which the bolt 20 connecting the above bundle is inserted.

In addition, the gas flow channel defining member 43 includes a thin portion 46 which connects between the pair of thick portions 45, whose amount of protrusion from the inner circumferential surface of the outer casing body 12 in a radially inward direction is smaller than those of the thick portions 45 and which has a ring shape of substantially half a circle around the axis O.

In the thin portion 46, a through hole 47 that communicates with the inside of the intake volute B1 and the auxiliary opening 26 is formed to be continuous with the auxiliary opening 26.

In this manner, due to the gas flow channel defining member 43, the intake volute B1 is formed such that a radial distance between the rotation shaft 2 and an inner surface (the inner circumferential surface of the gas flow channel defining member 43) of the intake volute B1 decreases away from positions at which the main intake nozzle 21 and the auxiliary intake nozzle 22 are provided in the circumferential direction.

According to the centrifugal compressor 1 of the present embodiment described above, the plurality of intake nozzles 16 that communicate with the intake volute B1 are provided at intervals in the circumferential direction. That is, in the present embodiment, the plurality of main intake nozzles 21 and auxiliary intake nozzles 22 are provided at intervals in the circumferential direction. Therefore, the processing gas portions G flowing into the intake volute B1 from the intake nozzles 16 collide with each other in the intake volute B1 so that a direction in which the processing gas G flows can be quickly changed to the direction of the axis O.

Therefore, even if the intake volute B1 is small, there is no need to separately provide a member for quickly changing a direction in which the processing gas G flows to the direction of the axis O in the intake volute B1. Therefore, it is possible to prevent the occurrence of release of the processing gas G in the intake volute B1 or the like unlike when such a separate member is provided.

In addition, since the guide wings 41 and the entrance rectification plate 42 are also unnecessary, it is possible to reduce the size of the casing 10 in the direction of the axis O.

Further, the processing gas G is taken into the intake volute B1 from the main intake nozzle 21 and the auxiliary intake nozzle 22, that is, the processing gas G is taken into the intake volute B1 from two parts in the circumferential direction. Therefore, the processing gas G uniformly flows into the intake volute B1 in the circumferential direction and the processing gas G can be uniformly introduced into the flow channel FC of the impeller 3 in the circumferential direction.

In this manner, in the present embodiment, since the plurality of intake nozzles 16 are provided and the processing gas G is taken into the intake volute B1, it is possible to reduce the size while maintaining performance.

In addition, in the present embodiment, when the main intake nozzles 21 and the auxiliary intake nozzles 22 are arranged with equal intervals in the circumferential direction, the processing gas portions G from the main intake nozzles 21 and the auxiliary intake nozzles 22 are taken into the intake volute B1 to face each other. Therefore, it is possible for the processing gas portions G to effectively collide with each other so that it is possible to introduce the processing gas G more uniformly into the flow channel FC of the impeller 3 in the circumferential direction, and further improve performance.

Further, in the present embodiment, when the gas flow channel defining member 43 is provided, a flow channel area in the intake volute B1 decreases away from the intake nozzles 16 in the circumferential direction. Therefore, it is possible to increase a flow velocity of the processing gas G at a position away from the intake nozzles 16 and it is possible to further uniformize a flow rate of the processing gas G introduced into the flow channel FC of the impeller 3 in the circumferential direction.

While the main intake nozzles 21 and the auxiliary intake nozzles 22 are arranged with equal intervals in the circumferential direction in the present embodiment, the present invention is not limited thereto. That is, the main intake nozzles 21 and the auxiliary intake nozzles 22 may be provided at least at intervals in the circumferential direction.

Moreover, the guide wings 41, the entrance rectification plate 42, and the gas flow channel defining member 43 may not necessarily be provided. In addition, the entrance rectification plate 42 may also be provided in the vicinity of the auxiliary opening 26 formed in the outer casing body 12.

Figure 3:
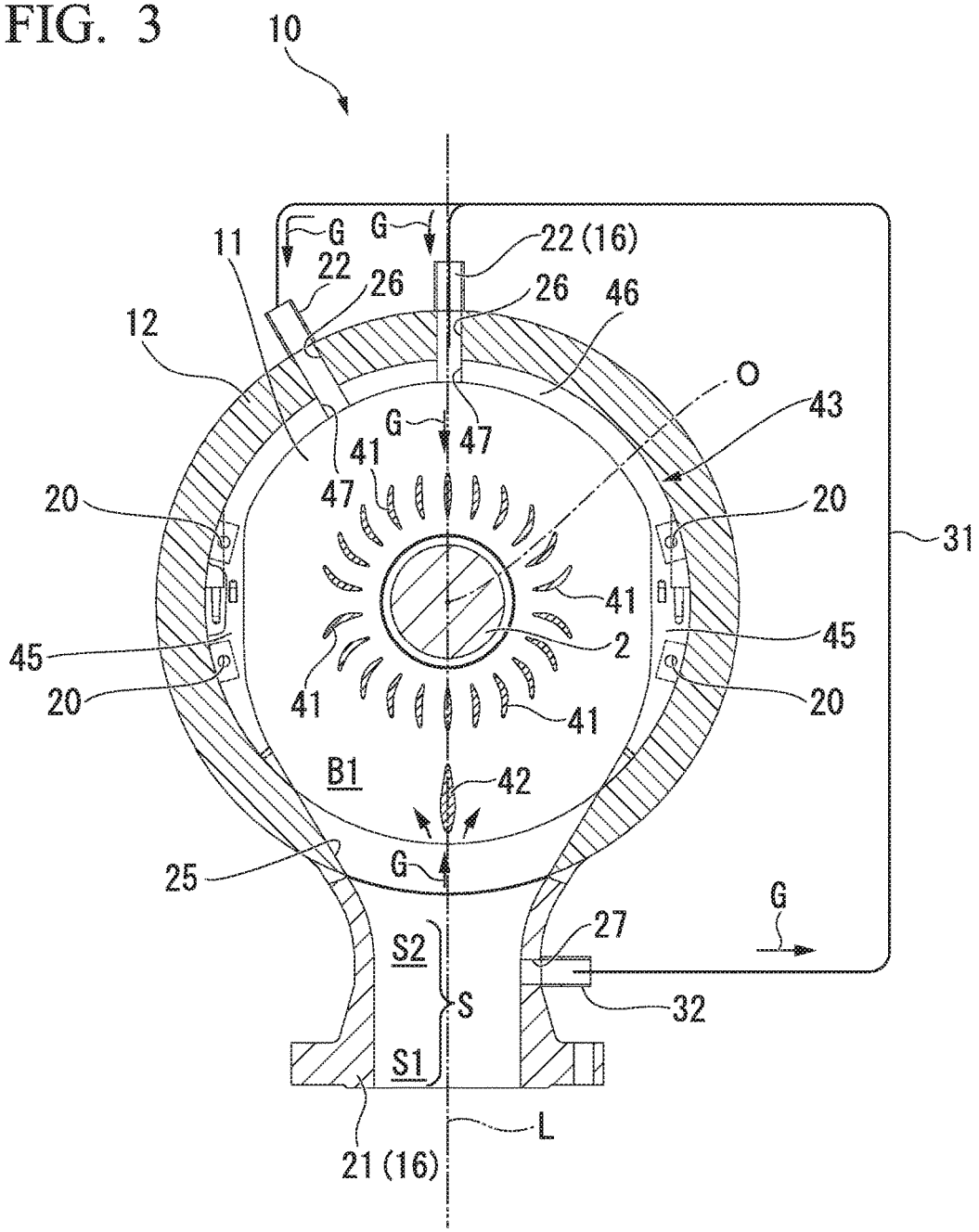
FIG. 3 is a cross-sectional view orthogonal to an axis of a rotation shaft of a centrifugal-compressor casing according to a modification of the first embodiment of the present invention and is a cross-sectional view at a position corresponding to the cross section A-A in FIG. 1.

In addition, as shown in FIG. 3, as the intake nozzles 16, the plurality of auxiliary intake nozzles 22 are provided apart from each other in the circumferential direction. The bypass line 23 may be connected to the plurality of auxiliary intake nozzles 22 in a diverging manner.

In addition, a position at which the connecting portion 32 of the bypass line 23 is installed, that is, a position at which the opening for bypass 27 is formed may be a position that is as far from the main opening 25 as possible. That is, the connecting portion 32 may be provided to communicate with the first space S1 and the connecting portion 32 may be provided in a pipe (not shown) connected to the intake nozzle 16. Accordingly, a differential pressure between the connecting portion 32 and the auxiliary intake nozzle 22 becomes higher and the processing gas G can flow more smoothly from the intake nozzle 16 into the bypass line 23. In addition, the connecting portion 32 may be provided to extend along a horizontal plane from the intake nozzle 16.

Second Embodiment

Figure 4:
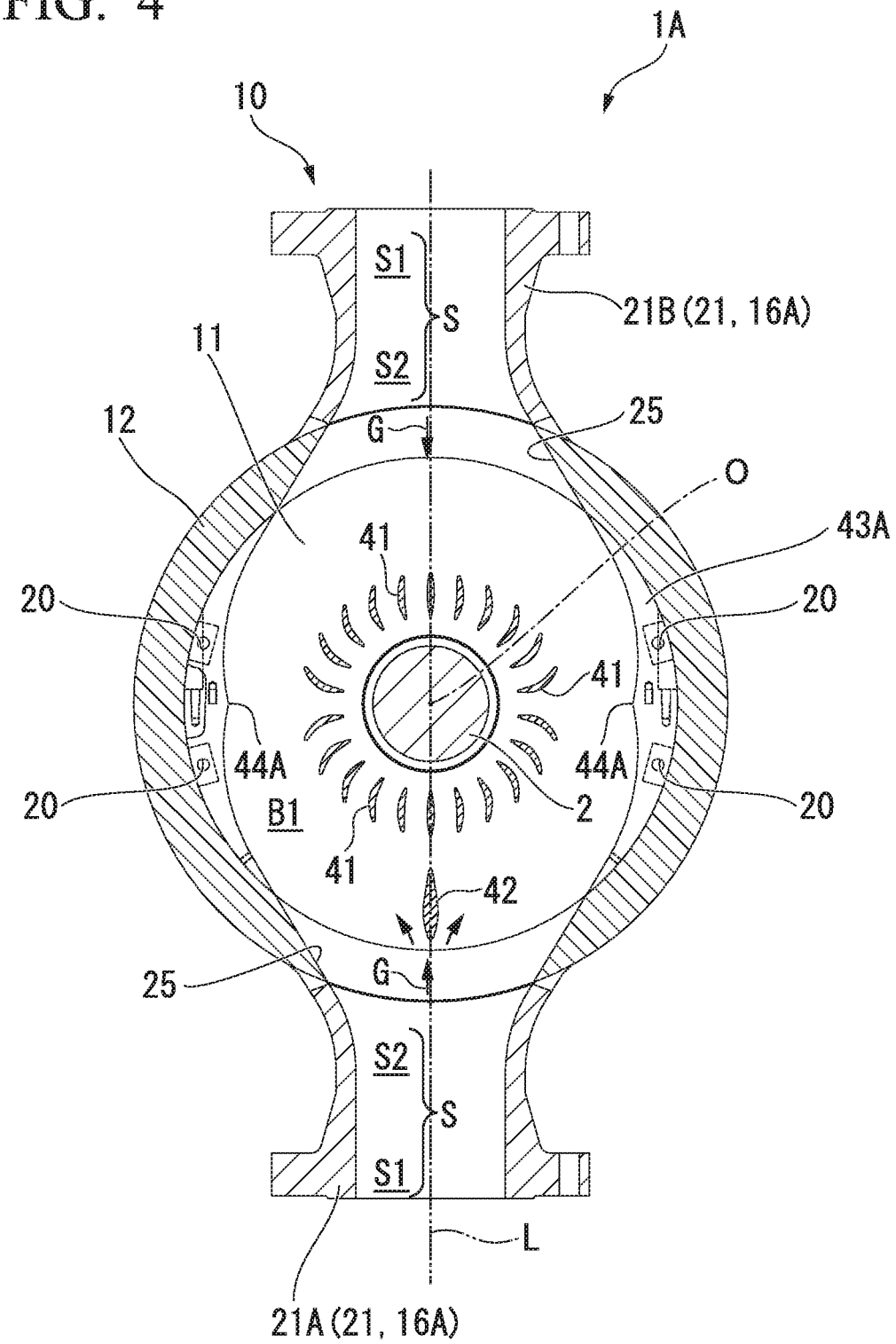
FIG. 4 is a cross-sectional view orthogonal to an axis of a rotation shaft of a centrifugal-compressor casing according to a second embodiment of the present invention and is a cross-sectional view at a position corresponding to the cross section A-A in FIG. 1.

Next, a second embodiment of the present invention will be described with reference to FIG. 4.

Components the same as those in the first embodiment are denoted by the same reference numerals and details thereof will not be described.

In a centrifugal compressor 1A of the present embodiment, intake nozzles 16A are different from those of the first embodiment.

That is, in the centrifugal compressor 1A, as the intake nozzles 16A, a plurality of (two) main intake nozzles 21 which are the same as those in the first embodiment are provided apart from each other in the circumferential direction around the rotation shaft 2.

In addition, the auxiliary intake nozzle 22 and the bypass line 23 of the first embodiment are not provided in the centrifugal compressor 1A of the present embodiment.

That is, the main intake nozzles 21 are provided vertically symmetrically with respect to a horizontal plane. That is, the main intake nozzles 21 are provided to protrude vertically along the above imaginary line L from the outer casing body 12.

In the present embodiment, the entrance rectification plate 42 is provided only in the vicinity of the main opening 25 of the outer casing body 12 corresponding to a lower main intake nozzle 21A, but is not provided in the vicinity of the main opening 25 of the outer casing body 12 corresponding to an upper main intake nozzle 21B. However, the entrance rectification plate 42 may be provided on both upper and lower sides or the entrance rectification plate 42 may not be provided at all.

In addition, in the present embodiment, a gas flow channel defining member 43A is provided to protrude in a radially inward direction from the inner circumferential surface of the outer casing body 12 only near positions on both sides in the circumferential direction 90 degrees away from the imaginary line L, that is, away from a position at which the main opening 25 is formed. The gas flow channel defining member 43A is smoothly continuous without a step from the upper and lower main openings 25 of the outer casing body 12.

In addition, in the gas flow channel defining member 43A, a top 44A is formed so that an amount of protrusion in a radially inward direction is maximized at a position 90 degrees apart from a position of the imaginary line L on both sides in the circumferential direction.

Due to the gas flow channel defining member 43A, a radial distance between the rotation shaft 2 and the inner surface (the inner circumferential surface of the gas flow channel defining member 43A) of the intake volute B1 decreases away from a position at which the main intake nozzle 21 is provided in the circumferential direction around the rotation shaft 2. At a position at which the top 44A is formed, the radial distance between the rotation shaft 2 and the inner surface of the intake volute B1 is the smallest.

According to the centrifugal compressor 1A of the present embodiment described above, the processing gas portions G flowing into the intake volute B1 from the main intake nozzles 21 collide with each other in the intake volute B1 so that it is possible to quickly change a direction in which the processing gas G flows to the direction of the axis O.

Therefore, it is possible to uniformly introduce the processing gas G into the flow channel FC of the impeller 3 in the circumferential direction while the occurrence of release of the processing gas G in the intake volute B1 or the like is prevented. Accordingly, it is possible to reduce the size while maintaining performance.

Figure 5:
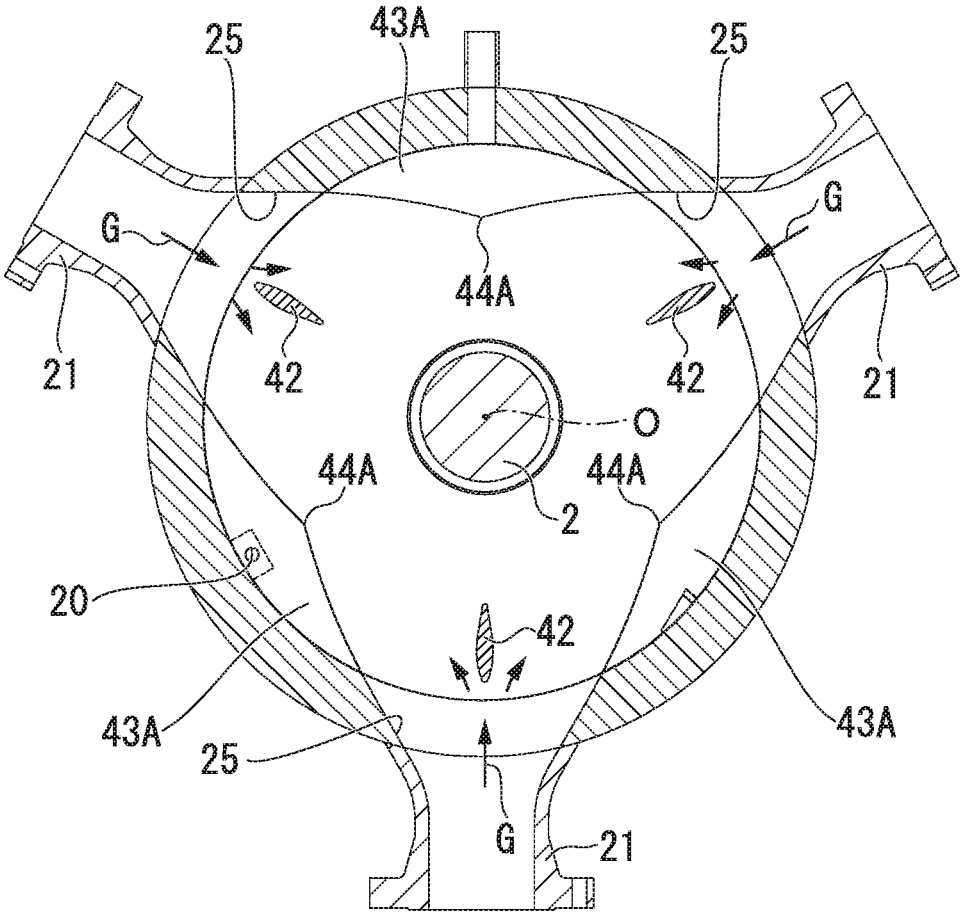
FIG. 5 is a cross-sectional view orthogonal to an axis of a rotation shaft of a centrifugal-compressor casing according to a modification of the second embodiment of the present invention and is a cross-sectional view at a position corresponding to the cross section A-A in FIG. 1.

Here, as shown in FIG. 5, the three main intake nozzles 21 may be provided with equal intervals in the circumferential direction. In the example in FIG. 5, no guide wings 41 are provided, and the entrance rectification plates 42 are provided at positions corresponding to the main intake nozzles 21.

As exemplified in FIG. 5, when the three or more main intake nozzles 21 are provided, the effect of change in the flow direction due to collision of the processing gas portions G from the main intake nozzles 21 and the effect of a uniform flow rate of the processing gas G in the intake volute B1 in the circumferential direction are enhanced. Therefore, even if no guide wings 41 is provided, it is possible to further uniformly introduce the processing gas G into the flow channel FC of the impeller 3 in the circumferential direction. Accordingly, it is possible to further reduce the size while maintaining performance of the centrifugal compressor.

The embodiments of the present invention have been described in detail above with reference to the drawings, but configurations in the embodiments and combinations thereof are only examples, and additions, omissions, substitutions and other modifications of the configurations can be made without departing from the scope of the present invention. In addition, the present invention is not limited to the embodiments and is only limited by the scope of the appended claims.

INDUSTRIAL APPLICABILITY

In the above centrifugal-compressor casing and centrifugal compressor, when the plurality of intake nozzles are provided, it is possible to reduce the size while maintaining performance.

REFERENCE SIGNS LIST

1, 1A centrifugal compressor
2 Rotation shaft
3, 3*a*, 3*b* Impeller
10 Casing
11 Casing body
11*a* Diaphragm
11*b* Head
12 Outer casing body
13*a* Thrust bearing
13*b* Radial bearing
15 Discharge nozzle
16, 16A Intake nozzle
20 Bolt
21, 21A, 21B Main intake nozzle
22 Auxiliary intake nozzle
23 Bypass line
25 Main opening
26 Auxiliary opening
27 Opening for bypass
31 Pipe portion
32 Connecting portion
41 Guide wing
42 Entrance rectification plate
43, 43A Gas flow channel defining member
44A Top
45 Thick portion
46 Thin portion
47 Through hole
B1 Intake volute
B2 Discharge volute
S Space
S1 First space
S2 Second space
L Imaginary line
O Axis
FC Flow channel
G Processing gas (fluid)

The invention claimed is:

1. A centrifugal-compressor casing comprising:

a casing body configured to rotatably support a rotation shaft and an impeller fixed to the rotation shaft around an axis of the rotation shaft, the casing body in which an intake volute which has a ring shape centered on the axis and through which a fluid is caused to flow in a direction of the axis and is introduced into a flow channel of the impeller, and a discharge volute which has a ring shape centered on the axis and through which the fluid is discharged from the flow channel of the impeller are formed;

a plurality of intake nozzles which communicate with the intake volute and are able to cause the fluid to flow into the intake volute from the outside of the casing body and are provided at intervals in a circumferential direction around the rotation shaft; and an outer casing which covers the casing body, wherein the plurality of intake nozzles include a main intake nozzle that is provided in the outer casing at one part in the circumferential direction around the rotation shaft and an auxiliary intake nozzle that is provided in the outer casing apart from the main intake nozzle in the circumferential direction around the rotation shaft, and wherein the centrifugal-compressor casing further includes a bypass line which connects the main intake nozzle and the auxiliary intake nozzle and through which the fluid is able to flow.

2. The centrifugal-compressor casing according to claim 1, wherein the plurality of intake nozzles are arranged with equal intervals in the circumferential direction around the rotation shaft.

3. The centrifugal-compressor casing according to claim 2, wherein, in the casing body, the intake volute is formed such that a radial distance between the rotation shaft and an inner surface of the intake volute decreases away from positions at which the intake nozzles are provided in the circumferential direction around the rotation shaft.

4. A centrifugal compressor comprising:

the casing according to claim 2;

a rotation shaft that is supported by the casing to be rotatable with respect to the casing; and an impeller that is fixed to the rotation shaft and rotates in the casing body together with the rotation shaft.

5. The centrifugal-compressor casing according to claim 1, wherein, in the casing body, the intake volute is formed such that a radial distance between the rotation shaft and an inner surface of the intake volute decreases away from positions at which the intake nozzles are provided in the circumferential direction around the rotation shaft.

6. A centrifugal compressor comprising:

the casing according to claim 1;

a rotation shaft that is supported by the casing to be rotatable with respect to the casing; and an impeller that is fixed to the rotation shaft and rotates in the casing body together with the rotation shaft.

* * * * *